US005522211A

United States Patent [19]

Knabel et al.

[11] Patent Number: 5,522,211

[45] Date of Patent: Jun. 4, 1996

[54] GUIDE FOR THE SHAFT OF AN OPEN-END SPINNING ROTOR

[75] Inventors: Manfred Knabel, Ingolstadt; Josef Breitenhuber, Buxheim; Edmund Schuller, Ingolstadt, all of Germany

[73] Assignee: Rieter Ingolstadt Spinnereimaschinenbau AG, Ingolstadt, Germany

[21] Appl. No.: 381,208

[22] Filed: Jan. 31, 1995

Related U.S. Application Data

[62] Division of Ser. No. 103,835, Aug. 6, 1993.

[30] Foreign Application Priority Data

Aug. 7, 1992 [DE] Germany ..... 42 26 193.7

[51] Int. Cl.[6] ..... D01H 4/00; F16C 32/06

[52] U.S. Cl. ..... 57/406; 57/404; 384/107

[58] Field of Search ..... 384/117, 118, 384/111, 112, 107, 121; 57/406, 104, 105, 404

[56] References Cited

U.S. PATENT DOCUMENTS

| | | | |
|---|---|---|---|
| 2,683,636 | 7/1954 | Wilcox | 384/121 |
| 2,684,272 | 7/1954 | Annen | 384/111 |
| 4,167,845 | 9/1979 | Munnuch et al. | 57/104 |
| 4,574,577 | 3/1986 | Derichs et al. | 57/100 |
| 4,653,265 | 3/1987 | Stahlecker et al. | 57/406 |
| 4,763,465 | 8/1988 | Raasch | 57/88 |
| 4,763,469 | 8/1988 | Stahlecker et al. | 57/407 |
| 4,773,210 | 9/1988 | Landwehrkamp et al. | 57/406 |
| 5,098,205 | 3/1992 | Zehnbauer et al. | 384/121 |

FOREIGN PATENT DOCUMENTS

| | | |
|---|---|---|
| 3523116 | 1/1987 | Germany . |
| 3622523 | 7/1988 | Germany . |
| 3942612 | 6/1991 | Germany . |

*Primary Examiner*—William Stryjewski
*Attorney, Agent, or Firm*—Dority & Manning

[57] ABSTRACT

An open-end spinning machine having a spinning rotor attached to a shaft is provided wherein the shaft of the spinning rotor is driven by driving means. The shaft of the spinning rotor is held in the nips of pairs of rearward and forward supporting disks. During spinning operations, an axial force is generated in the axial direction of the free end of the rotor shaft. The open-end spinning device further comprises a radial support surrounding at least a portion of the circumference of the rotor shaft and disposed at least in part in the area between the free end of the shaft and the area of the shaft acted upon by the rearward pair of disks.

11 Claims, 3 Drawing Sheets

GUIDE FOR THE SHAFT OF AN OPEN-END SPINNING ROTOR

This is a division of application Ser. No. 08/103,835 filed Aug. 6, 1993.

BACKGROUND OF THE INVENTION

The instant invention relates to an open-end rotor spinning device as well as to an aerostatic axial bearing for the spinning rotor.

A rotor spinning device of this type is known from DE 39 42 612 A1. In such a device the shaft is mounted in a nip of supporting disks and is driven by means off a drive, e.g. a tangential belt. An axial thrust upon the rotor shaft which is supported by an aerostatic axial bearing is produced via the supporting disks. This aerostatic bearing is located at the free end of the rotor shaft away from the rotor and is installed on the machine housing or on the seat of the bearing of the supporting disks. In an effort to continually increase the rotational speed of the rotor to the point where it is now around 120,000 RPMs and more, the shafts of the open-end spinning rotors were continually shortened so that the distance between the bearing points of the rotor shaft on the supporting disks has also become shorter and shorter in axial direction. In addition to the bearing points of the rotor on the supporting disks, the tangential belt or a driving disk driving the rotor also constitutes an additional fastening of the rotor because the shaft is thereby pushed into the nips of the supporting disk pairs.

With open-end spinning devices in which the shaft of the spinning rotor is axially supported upon a ball, such as is shown in DE 36 22 523 A1 for example, it is a known method to design the seals of the axial bearing so that when the supporting disk diameter changes, the rotor shaft is able to move against a sliding surface in order to save the seal of the axial bearing. In this design the overhang of the shaft, i.e. the length of the shaft from the supporting disk pair toward the axial bearing to the free end of the rotor shaft measures approximately 20 mm.

In the rotor spinning device of the type according to DE 39 42 612 A1, the overhang of the free end of the rotor shaft is very short in the actual model. Thus, very high rotational speeds can be attained with the rotor since the short overhang of the free end of the rotor shaft has a very favorable effect upon the oscillation attitude of the rotor shaft. The short overhang can be achieved in the rotor bearing of that type in that the aerostatic axial bearing only influences the surface of the free end of the rotor shaft. In axial bearings which are operated by means of an oil-lubricated ball, expensive measures are required to seal off the oil vapors which emerge from such a bearing and soil the rotor spinning device. The open-end spinning device of this type has also the disadvantage that the space availability at the free end of the shaft is extremely restricted. This has as a consequence that a radial guidance of the shaft end could not be used in the past. Such a radial support is especially favorable when the rotor is greatly out of balance because of said rotor being soiled and runs unsteadily. It is possible here that the aerostatic bearing is under greater stress from the radially oscillating free end of the rotor shaft, so that damage to the bearing is possible in spite of good emergency running characteristics.

OBJECTS AND SUMMARY OF THE INVENTION

It is a principal object of the instant invention to design an open end spinning device in such a manner that the device can be made with a radial guidance of the free end of the rotor shaft without abandoning the favorable geometric configuration of the open-end spinning device.

Furthermore an improved aerostatic axial bearing is provided which can be used to advantage, in particular with an open-end spinning device according, and which offers a compact configuration of support and axial bearing. Additional objects and advantages of the invention will be set forth, or will be obvious, from the description which follows, or may be learned by practice of the invention.

The objects are attained by the invention through the presently described embodiments. The design according to invention of the open-end spinning device makes it possible to make the rotor shaft short, so that the rotor can be operated at the highest possible rotor speed. The arrangement of the support, at least in part within the last 5 mm of the rotor shaft, is achieved in that the support counteracts the radial movement of the rotor shaft with an advantageous lever arm. Thanks to the shortness of the free end of the rotor shaft, measuring up to 10 mm, it becomes possible to make the rotor shaft as short as possible so that its oscillation behavior is especially favorable and to make at the same time sufficient space available so that a support can be installed near the free end of the rotor shaft. It is especially advantageous for the support to be located at least in part in the area of the part of the rotor shaft which is acted upon by the supporting disks, as this allows at the same time sufficient axial extension for the support so that it may absorb the movements of the rotor shaft while the projection of the free end of the rotor shaft can nevertheless be kept short. It is advantageous for the support to be made in the form of a cup so that the rotor shaft is able to bear on the support not only in a linear manner, but also over a surface. This has a favorable influence upon the wear of the support and upon the load on the rotor shaft. The open-end spinning device becomes especially simple and compact thanks to the fact that the support and the axial bearing together constitute one component. If the support is not touched by the rotor shaft in normal operation, this has the advantage that no braking forces are transmitted to the rotor shaft and so that the latter can be operated without energy loss. If the support is designed so that it supports the rotor shaft over a length of at least 2 mm, this ensures sufficient wear life as well as reliable support in operation. It is especially advantageous for the support to be made of a wear-resistant, heat-resistant material because a sufficient life time and non-destructive interaction with the rotor shaft can thus be achieved. Carbon materials have proven to be especially advantageous for this, since they produce but little friction resistance.

If an aerostatic axial bearing is designed according to the invention, the known axial bearings are improved thereby to such an extent that they constitute a support for the rotor shaft and that the entire unit can at the same time be made compact and reliable. The integrated configuration of the support makes it possible for it to be positioned precisely in relation to the bearing plate. Adjustment of support in relation to the rotor shaft is effected automatically together with the adjustment of the bearing plate in relation to the rotor shaft. Thus an axial bearing with a considerable longer life span is made available, because radial movements of the rotor shaft which would cause a misalignment of the shaft end in relation to the bearing plate are prevented. Axial bearings of this design have a much longer life span. By installing the support directly at the bearing plate, it is possible to make the free end of the rotor shaft which extends over the supporting disks extremely short. It is especially advantageous in that case if the support is designed so that it surrounds the rotor shaft in the manner of a cup. The best design in this case is for the support to guide the end of the rotor shaft in the manner of a bushing. By designing the axial bearing with a seat for the support it is possible for the latter to be combined with the axial bearing while the forces which are introduced into the support can at the same time be supported by the axial bearing. An especially compact design is achieved if the bearing plate and the support are made in one piece. Since practically the same wear-resistance and heat-resistance requirements are imposed upon the support, the combination of the two parts can be made of the same material. A carbon material has proven to be an especially advantageous material for the support and also for the bearing plate.

The invention is described below through drawings which constitute a part of this description.

DETAILED DESCRIPTION OF THE PREFERRED EMBODIMENTS

Figure 1:
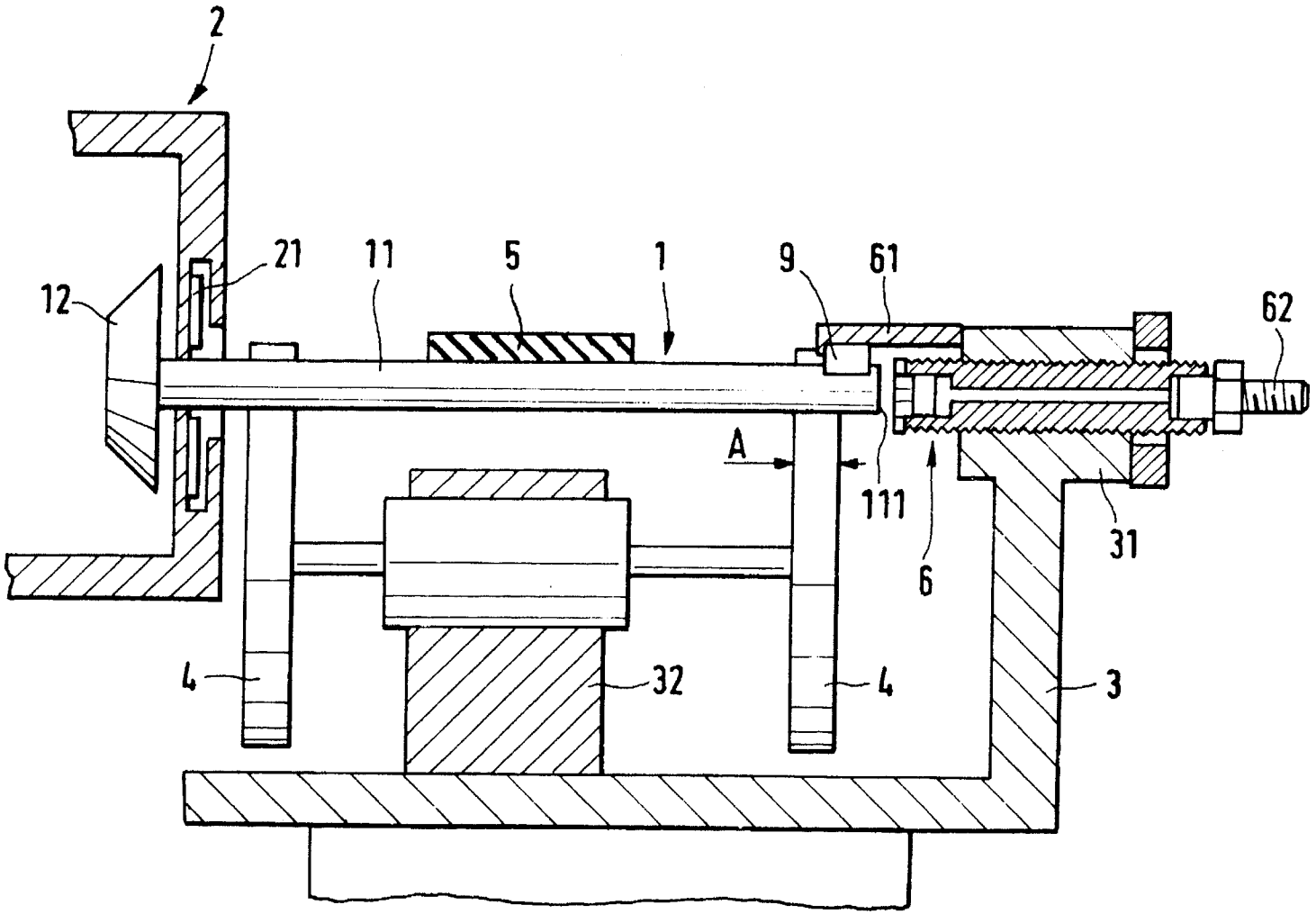
FIG. 1 shows a lateral view of a device according to the invention.

Reference will now be made in detail to the presently preferred embodiments of the invention, one or more examples of which are illustrated in the accompanying drawings. Each example is provided by way of explanation of the invention, not limitation of the invention. In fact, various modifications and variations can be made in the invention without departing from the scope or spirit of the invention. The numbering of components in the drawings is consistent throughout the application, with the same components having the same number in each of the drawings.

FIG. 1 shows a lateral view of an open-end spinning device according to the invention, partially cut-away. The essential components are the spinning rotor 1 with its shaft 11 and the rotor plate 12, the housing 2 with the rotor housing seal 21, the pillow block 3 with the component 31 for the fastening of the axial bearing 6 and a seat 32 for the mounting of the supporting disks 4, the supporting disks 4 arranged by pairs to receive the rotor shaft, the drive means, a tangential belt 5 to drive the spinning rotor 1 and the aerostatic axial bearing 6 for axial support of the rotor shaft 11. Near the pair of supporting disks in proximity of the spinning rotor 12, as well as near the pair of supporting disks 4 in proximity of the free end 111 of the rotor shaft, only one supporting disk of the pair is shown in the drawing. The spinning rotor 12 is driven over the tangential belt 5. The aerostatic axial bearing 6 upon which the rotor shaft 11 bears axially is provided with a connection 62 which is supplied with compressed air via the axial bearing. According to the invention, the open-end spinning device is provided with a support 9 which is attached to component 31 via a holding device 61. This component 31 is in turn connected to the pillow block 3 and bears upon it. The support 9 is made approximately in the form of a half cup and surrounds the rotor shaft 11 without touching it during normal operation of the open-end spinning device. Although a support according to the invention can also be designed so that it does touch the rotor during operation, a support which does not touch the rotor in normal operation is sufficient and requires less energy. The support 9 limits tendencies of the rotor to tilt around its point of support on the forward supporting disk pair to such an extent that the axial bearing is not damaged and is not subjected to any increased stress. The distance between the two pairs of supporting disks is shown to be relatively great in FIG. 1,for the sake of clarity. In practice, the distance can however be much shorter, since the rotor shaft can still be supported sufficiently securely in the nip of the supporting disks in an open-end spinning device equipped according to the invention. With the application of the instant invention, the distance between the pairs of supporting disks and thereby the length of the rotor shaft need no longer be adapted to the worst operating conditions of the spinning rotor. Oscillations and movements of the spinning rotor out of the nip of the supporting disks are reliably avoided with the support 9 according to the invention. The support 9 is made in the form of a cup and extends from the vicinity (A) of the rotor shaft which interacts with the supporting disk pair near the axial bearing almost to the free end 111 of the rotor shaft 11. The short length of the free end 111 of the rotor shaft 11, measuring at the most 10 mm, makes it possible for the rotor shaft to be made extremely short, whereby the support 9 ensures at the same time that the running of the spinning rotor is so smooth in relation to the axial bearing 6 that the latter cannot be damaged by radial oscillations of the shaft end. It is also possible to provide the support 9 only in the vicinity (A) of shaft 11, so that the overhang of the rotor shaft 11 over the pair of supporting disks 4 can be practically equal to zero. As a result of this the rotor shaft can be made especially short and with a length favorable to minimize oscillation. The distance between the free end 111 and the axial bearing 6 measures in reality only a few tenths of a millimeter during the operation of the open-end spinning device and is shown larger in FIG. 1 for the sake of greater clarity.

The support 9 can be fastened in a number of different ways, and in the present case it is connected via holding device 61 to the pillow block 3. The support 9 is made of a carbon material which is very wear-resistant and at the same does not work itself into the surface of the rotor shaft in case of contact. At the same time the material is also heat resistant, so that it does not fail even under stress for long periods of time. Between the support 9 and the surface of the rotor shaft 11, a gap which is especially advantageous if it measures less than 1/10th of a millimeter exists in normal operation. The axial extension of the support 9 measures approximately 8 mm.

FIG. 2 shows an advantageous embodiment of a support 9 according to the invention in which it is integrated into the axial bearing 6. The support 9 is in form of a bushing and encloses the free end of the rotor shaft in the manner of a bushing when the open-end spinning device is in operation. Radial movements of the rotor shaft out of its mounting can be suppressed reliably in this manner. The support 9 is held in the basic body 310 of the axial bearing 6 through seat 60. This can be achieved by pressing the support in seat 60 and body 310. The support 9 extends in this case approximately 2 mm beyond the bearing plate 63. Since the bearing gap between bearing plate 63 and rotor shaft end 11 is less than 1/10 mm, the axial extension of the support 9 suffices to provide a secure support of the rotor shaft against radial oscillations. The axial bearing 6 is furthermore provided with a choke 8 as well as with a connection 62 for compressed air. The bushing 90 which constitutes the support 9 can bear either directly on the bearing plate in axial direction or bear upon an intermediate ring which surrounds the bearing plate 63 radially.

Figure 2A:
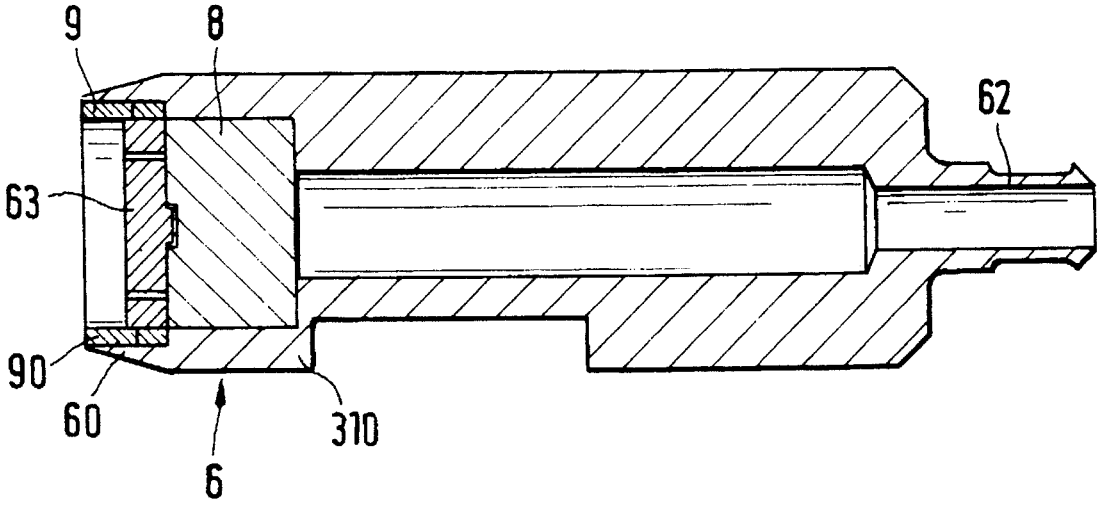
FIG. 2*a* shows an embodiment of the axial bearing of FIG. 1 according to the invention.
Figure 2B:
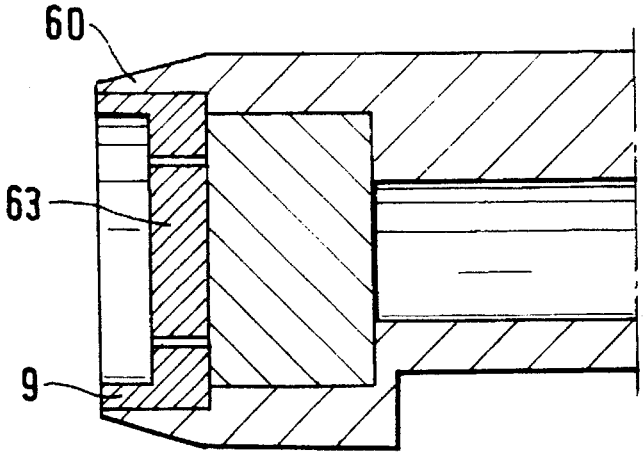
FIG. 2*b* shows a partial cut-away view of an axial bearing according to the invention.

FIG. 2*b* shows part of the axial bearing 6 according to the invention in which a support 9, made in one piece with the bearing plate 63, is provided in the seat 60 of the base body 310. In FIG. 2*a* as well as in FIG. 2*b*, the bearing plate 63 is made of a carbon material which is wear resistant and heat resistant.

Figure 3:
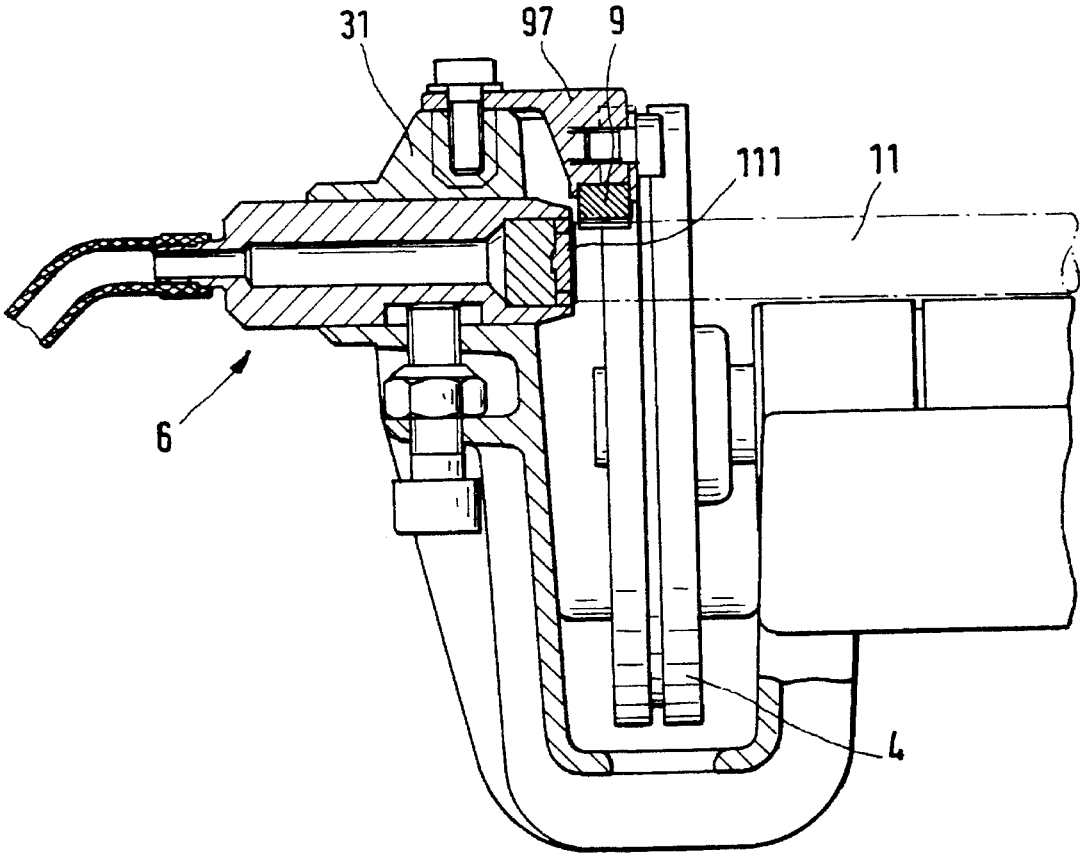
FIG. 3 shows an enlarged representation of the area of the rotor shaft end of an open-end spinning device designed according to the invention.

In the partial view of FIG. 3 of the open-end spinning device according to the invention is equipped with a support 9 which is located in the area of the free end of the rotor shaft, similarly as in FIG. 1. The free end 111 of the rotor shaft 11 has a projection of 3 mm beyond the supporting disks 4 and the support 9 has an axial extension of approximately 6 mm, whereby it also reaches in part around in the area of the rotor shaft which is acted upon by the supporting disks. The support 9 is held in a holding device 97 which is screwed to the component 31 by means of a screw. The side of the support 9 toward the rotor shaft is cup-shaped and adapted to the contour of the rotor shaft and thereby prevents undesirable radial movements of the rotor shaft in an especially effective manner. The projection of the free end of the rotor shaft 111 can be further shortened, either if a support 9 with less axial extension is used, or if the support 9 is installed over the supporting disks.

It will be apparent to those skilled in the art that various modifications and variations can be made in the invention. For instance, features illustrated or described as part of one embodiment can be used on another embodiment to yield a still further embodiment. Thus, it is intended that the present invention cover such modifications and variations as come within the scope of the appended claims and their equivalents.

We claim:

1. An open-end spinning machine with a spinning rotor having a shaft with a free end, said shaft being driven by driving means wherein the shaft of the spinning rotor is held in the nips of pairs of rearward and forward supporting disks, said machine further comprising a radial support configured to act upon at least a portion of the circumference of said rotor shaft, said radial support comprising a cup-shaped device having a substantially flat bearing surface oppositely facing and larger than said shaft free end and a longitudinal section extending circumferentially about said rotor shaft along a length of said shaft from said flat bearing surface in the direction of said rotor.

2. The open-end spinning machine as in claim 1, further comprising an aerostatic axial bearing configured with said flat bearing surface so as to act upon said rotor shaft free end.

3. The open-end spinning machine as in claim 2, wherein said axial bearing comprises a base body defining a seat, said radial support being disposed in said seat.

4. The open-end spinning machine as in claim 3, wherein said radial support is configured at least in part as a bushing device.

5. The open-end spinning machine as in claim 2, wherein said axial bearing comprises a bearing plate, said bearing plate and said radial support being formed as integral components.

6. An open-end spinning device with a spinning rotor having a shaft with a free end wherein in operation of said spinning device axial force generated is as a result of spinning operations in the direction of said shaft free end, said spinning device further comprising an aerostatic axial bearing comprising a base body having a bearing plate configured therein oppositely facing and larger than said shaft free end, said axial bearing further comprising a radial support configured to act upon at least a portion of the circumference of said rotor shaft, said radial support in communication with said bearing plate and extending longitudinally along said shaft from said bearing plate in the direction of said spinning rotor.

7. The open-end spinning device as in claim 6, wherein said radial support is formed at least in part as a cup-shaped element and is configured to at least partly surround said rotor shaft interacting with said axial bearing.

8. The open-end spinning device as in claim 6, wherein said axial bearing further comprises a seat configured therein, said radial support supported by said seat.

9. The open-end spinning device as in claim 6, wherein said bearing plate and said radial support comprise an integral component.

10. The open-end spinning device as in claim 6, wherein said radial support is formed of a wear and heat resistant material.

11. The open-end spinning device as in claim 10, wherein said radial support is formed of a carbon material.

* * * * *